US006945439B2

(12) United States Patent
Damrath et al.

(10) Patent No.: US 6,945,439 B2
(45) Date of Patent: Sep. 20, 2005

(54) PRESSING DUMMY WITH AIR-STREAM-DEPENDENT AIR-DEFLECTING DEVICE

(75) Inventors: Joachim Damrath, Bachhagel (DE); Markus Spielmannleitner, Ellwangen (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 116 days.

(21) Appl. No.: 10/600,910

(22) Filed: Jun. 20, 2003

(65) Prior Publication Data

US 2004/0011833 A1 Jan. 22, 2004

Related U.S. Application Data

(63) Continuation of application No. PCT/EP01/14118, filed on Dec. 3, 2001.

(30) Foreign Application Priority Data

Dec. 20, 2000 (DE) ..... 100 63 670

(51) Int. Cl.[7] ..... A41H 5/02
(52) U.S. Cl. ..... 223/67
(58) Field of Search ..... 223/57, 70, 74, 223/73, 67, 72

(56) References Cited

U.S. PATENT DOCUMENTS 2,417,838 A * 3/1947 Paris ..... 223/67

FOREIGN PATENT DOCUMENTS

| | | |
|---|---|---|
| DE | 1 106 284 | 5/1961 |
| DE | 197 30 358 A1 | 1/1999 |
| EP | 0 193 483 A1 | 9/1986 |

* cited by examiner

*Primary Examiner*—John J. Calvert
(74) *Attorney, Agent, or Firm*—John T. Winburn; Russell W. Warnock; Craig T. Loest

(57) ABSTRACT

A method and device for pressing items of clothing—in particular, shirts, blouses and jackets—includes a pressing dummy with an inflatable bag. At least a region of the inflatable bag extends into the neck, collar, or lower hem regions of the clothing. At the end of such region is disposed an air diverter for drying adjacent surfaces of the clothing item. The air diverter is connected to the inflatable bag as far as air supply is concerned. Should the airflow be weak or non-existent, then the air diverter—at least partly—retracts into the piece of clothing. Should the airflow be active, however, then the air diverter extends and takes on the form of a mushroom head. In such a form, the air diverter is in the working position thereof and, thus, ventilates the adjacent region of the piece of clothing from the underside of the mushroom head.

20 Claims, 1 Drawing Sheet

PRESSING DUMMY WITH AIR-STREAM-DEPENDENT AIR-DEFLECTING DEVICE

CROSS-REFERENCE TO RELATED APPLICATION

This application is a continuation of copending International Application No. PCT/EP01/14118, filed Dec. 3, 2001, which designated the United States and was not published in English.

BACKGROUND OF THE INVENTION

Field of the Invention

The invention relates to a method of, and an apparatus for, pressing items of clothing—in particular shirts, blouses and jackets—by a pressing dummy with an inflatable bag that, during pressing, is filled by an airflow, the inflatable bag having at least one sub-region extending into an opening of the item of clothing—which is intended for part of the human body—as far as the end of the item of clothing and which is provided with an air-deflecting device at these ends, it being possible for the airflow, likewise, to blow through the air-deflecting device and to influence the shape thereof.

German Published, Non-Prosecuted Patent Application DE 197 30 358 A1 proposes an apparatus in which pressing is carried out on a pressing dummy. Therein, the item of clothing has its bottom hem clamped on an annular mount. The sleeves and the shoulder and collar region are fixed by supporting and/or retaining elements. An inner drying-air stream inflates the item of clothing and, thus, dries and presses it. Because the collar and cuffs of an item of clothing include at least one double layer of fabric, they are more difficult to dry, on account of the higher moisture content. This apparatus, thus, provides air-deflecting elements for the cuffs and/or for the collar. These air-deflecting elements receive a partial air stream from the interior of the item of clothing and deflect this air stream onto the surface of the item of clothing. This means that, in addition to being supplied from the inside with heat energy and/or dry air, the collar and cuffs are also subjected to the action of the drying medium from the outside. This reduces the amount of time required for drying the thick-walled parts of the item of clothing. These air-deflecting elements have the disadvantage that, when the item of clothing on the pressing dummy is changed, they possibly have to be removed and refitted, and are, thus, troublesome.

European Patent Application EP 0 193 483 A1 (subsequent application in respect of French Patent Document FR 8500673) describes a method of, and a pressing dummy for, pressing items of clothing. In this document, the item of clothing, for pressing purposes, is pulled onto an inflatable bag of the pressing dummy. An air stream that blows into the interior of the inflatable bag blows through the latter and the item of clothing, the latter, then, being dried and pressed. Because the inflatable bag also engages in the sleeves of the item of clothing, the sleeves are, also, dried. In one configuration of the invention, the inflatable bag is extended beyond the cuffs (and possibly also beyond the collar) of the item of clothing. Flexible flaps are fitted on the outside of these extensions—i.e., in the region of the cuffs. They are, preferably, made of the same material as the inflatable bag. If, then, the item of clothing has been positioned on the pressing dummy and the air stream has been activated, then the air simultaneously flows through the inflatable bag and the flaps together. The air stream, then, inflates the inflatable bag and the flaps. The inflatable bag, then, positions itself against the item of clothing from the inside. For each cuff or collar, the flaps include—at least in part—two half-cylinder shells that are, for example, sewn on the inflatable bag by one end side. This geometrical shape does not allow the flaps to position themselves automatically against the cuff, that is to say, once the item of clothing has been fitted on the pressing dummy, these flaps have to be swung manually onto the cuffs. Conversely, this means that, when the item of clothing is removed, these flaps have to be swung away from the cuff. With a total of two cuffs for each item of clothing and possible flaps in the region of the collar, a large number of manipulations have to be carried out when the item of clothing is changed. This is very time-consuming and, thus, impractical.

SUMMARY OF THE INVENTION

It is accordingly an object of the invention to provide a pressing dummy with air-stream-dependent air-deflecting device that overcomes the hereinafore-mentioned disadvantages of the heretofore-known devices and methods of this general type and that finds a method or an apparatus (in the form of a pressing dummy) that eliminates, or at least reduces, the above-described disadvantages.

With the foregoing and other objects in view, there is provided, in accordance with the invention, a method of pressing items of clothing, including the steps of providing a pressing dummy having an inflatable bag with at least one sub-region extending into an opening of the item of clothing intended for part of a human body as far as at least one end of the clothing item during a pressing operation and an air-deflecting device disposed at the at least one end, and filling the inflatable bag with an airflow during the pressing operation to extend the at least one sub-region into the opening of the clothing item as far as the at least one end of the clothing item and to also blow through the air-deflecting device to influence a shape of the air-deflecting device and, dependent upon a compressive force of the airflow, to influence at least one of a position and an angle of a flow direction of the airflow. Preferably, the clothing items include shirts, blouses, and jackets.

According to the invention, use is made, for the purposes of drying and pressing the collar and/or cuffs and/or the bottom hem of an item of clothing, of an air-deflecting device, which, in contrast to the above-described prior-art flaps, are of very flexible configuration. By virtue of the inherent tensioning of this air-deflecting device and of the flexible configuration thereof, it can assume different shapes, in dependence on the intensity of the air stream in the inflatable bag. If the air stream is active—i.e., the pressing dummy is drying an item of clothing—then, (in this case using the sleeve/cuff example) this air-deflecting device pushes out of that sub-region of the inflatable bag that is located in the sleeve of the item of clothing, in the region of the cuff. These pushed-out portions (air-deflecting device) have air-permeable regions or nozzles. As a result, the air that passes out here can dry the cuff on its surface.

If pressing of the item of clothing has been completed, then the air stream of the pressing dummy is switched off, or at least reduced to make it easier for the item of clothing to be changed. By virtue of the inherent tensioning of the air-deflecting device, and because the compressive force of the air stream is no longer present, the air-deflecting device turns back into its initial position. It is additionally possible to provide resilient elements that draw the air-deflecting device, in particular, back into its initial position in the event of a decrease in the compressive force of the air stream.

These resilient elements may be worked into the material of the pressing dummy, for example, by weaving in elongate resilient elements or impregnating with a substance that is resilient once it has hardened, or may be formed by the material of the pressing dummy itself, the material being formed, in respect of thickness and/or shaping, to give a resilient effect. For such a purpose, it is also possible for the regions of the air-deflecting device to be made of a material that differs from that of the pressing dummy and has resilient properties.

It is possible for the resilient elements to be disposed, in a substantially cylindrical section of the pressing dummy, either longitudinally in the axial direction or transversely to the circumference to reduce the cross-section of the region of the air-deflecting device when the compressive force of the air stream decreases.

The air-deflecting device according to the invention may be realized, in principle, in two different ways. On one hand, the air-deflecting device may be the end of a sub-region of the inflatable bag. This is advantageous because the inflatable bag and this air-deflecting device, then, form a unit and can be produced together in the one production process. This reduces production costs and, thus, makes possible a cost-effective pressing dummy.

In many cases, however, it may be necessary for the air-deflecting device to form a separate component, that is to say, not to form part of the inflatable bag. This may be so when, for example, the pressing dummy is provided with a relatively stiff inflatable bag, which may be the case, for example, with a pressing dummy for heavy items of clothing.

It is also possible for the nature of the air-deflecting device to differ. The material properties of the latter provide it with elasticity and inherent tensioning. By virtue of this inherent tensioning, the air-deflecting device maintains its initial shape without the external action of force. The initial shape may be in the form of a turned-in portion directed toward the body of the pressing dummy or in the form of a rosette-like fold. It is also possible, however, for the air-deflecting device to be retained in its rest position by additional clamping elements. Conceivable clamping elements are resilient components such as pieces of elastic or clasps.

In accordance with another mode of the invention, there is provided the step of tensioning the air-deflecting device in an active airflow and, as a result, directing the flow direction of the airflow on a surface of the clothing item at the latest once the air-deflecting device has been tensioned to a full extent thereof.

In accordance with a further mode of the invention, there is provided the step of relieving the air-deflecting device of tensioning in an at least reduced airflow and, then, drawing the air-deflecting device back beneath a surface of the clothing item.

In accordance with an added mode of the invention, the directing step is carried out by directing the flow direction of the airflow on cuffs of the clothing item at the latest once the air-deflecting device has been tensioned to a full extent thereof, the cuffs being adjacent the air-deflecting device.

In accordance with an additional mode of the invention, the directing step is carried out by directing the flow direction of the airflow on a collar of the clothing item at the latest once the air-deflecting device has been tensioned to a full extent thereof, the collar being adjacent the air-deflecting device.

In accordance with yet another feature of the invention, the directing step is carried out by directing the flow direction of the airflow on a bottom hem of the clothing item at the latest once the air-deflecting device has been tensioned to a full extent thereof, the bottom hem being adjacent the air-deflecting device.

With the objects of the invention in view, there is also provided an apparatus for pressing items of clothing, including a pressing dummy having an inflatable bag with at least one sub-region extending into an opening of the item of clothing intended for part of a human body as far as at least one end of the clothing item during a pressing operation and an air-deflecting device disposed at the at least one end, the air-deflecting device extending the at least one sub-region into the opening of the clothing item as far as the at least one end of the clothing item when the inflatable bag is filled with an airflow during the pressing operation and having a shape influenced by the airflow blowing through the air-deflecting device and at least one of a position and an angle influenced by a flow direction of the airflow dependent upon a compressive force of the airflow, the at least one sub-region having an end, and the air-deflecting device being the end of the at least one sub-region and swelling out when influenced by the airflow.

With the objects of the invention in view, there is also provided an apparatus for pressing items of clothing, including a pressing dummy having an inflatable bag with at least one sub-region extending into an opening of the item of clothing intended for part of a human body as far as at least one end of the clothing item during a pressing operation and an air-deflecting device disposed at the at least one end, the air-deflecting device extending the at least one sub-region into the opening of the clothing item as far as the at least one end of the clothing item when the inflatable bag is filled with an airflow during the pressing operation and having a shape influenced by the airflow blowing through the air-deflecting device and at least one of a position and an angle influenced by a flow direction of the airflow dependent upon a compressive force of the airflow, the at least one sub-region having an end, and the air-deflecting device being parts formed integrally on the end of the at least one sub-region of the inflatable bag, In accordance with yet a further feature of the invention, the air-deflecting device has air holes.

In accordance with a concomitant feature of the invention, the air-deflecting device is at least partly of an air-permeable material.

If an air stream, then, is blown through the inflatable bag, the air-deflecting device curves outward. The air-deflecting device, then, passes in the form of a mushroom out of the sleeves or the collar or in the downward direction out of the bottom end of the inflatable bag—in the region of the bottom hem. The "mushroom head"—to maintain the comparison—then, rises up beyond the surface of the item of clothing. That surface of the "mushroom head" that is directed toward the item of clothing is of air-permeable configuration. This may be brought about in that either the air-deflecting device is of an open-cell material here or the air holes or nozzles are disposed in that surface of the "mushroom head" that is directed toward the item of clothing. That part of the mushroom head that is not directed toward the item of clothing, or the cap of the mushroom head, is, advantageously, of air-impermeable configuration to prevent air from flowing out at this location. Otherwise, the air passing out at this location would flow away without being used and result in unnecessary energy loss.

For the sake of completeness, it should be mentioned that it also possible, however, for the present invention to be used for pressing by a pressing dummy in which the inflatable bag is of air-impermeable configuration. In the case of these pressing dummies, drying takes place by way of an air stream acting on the item of clothing from the outside. The air stream in the interior of the inflatable bag, then, serves there merely for tensioning the inflatable bag and not for drying the item of clothing. It is also important here for the regions of the cuffs, of the collar, and, possibly, of the bottom hem to be dried by an additional air stream from the air-deflecting device according to the invention.

Other features that are considered as characteristic for the invention are set forth in the appended claims.

Although the invention is illustrated and described herein as embodied in a pressing dummy with air-stream-dependent air-deflecting device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
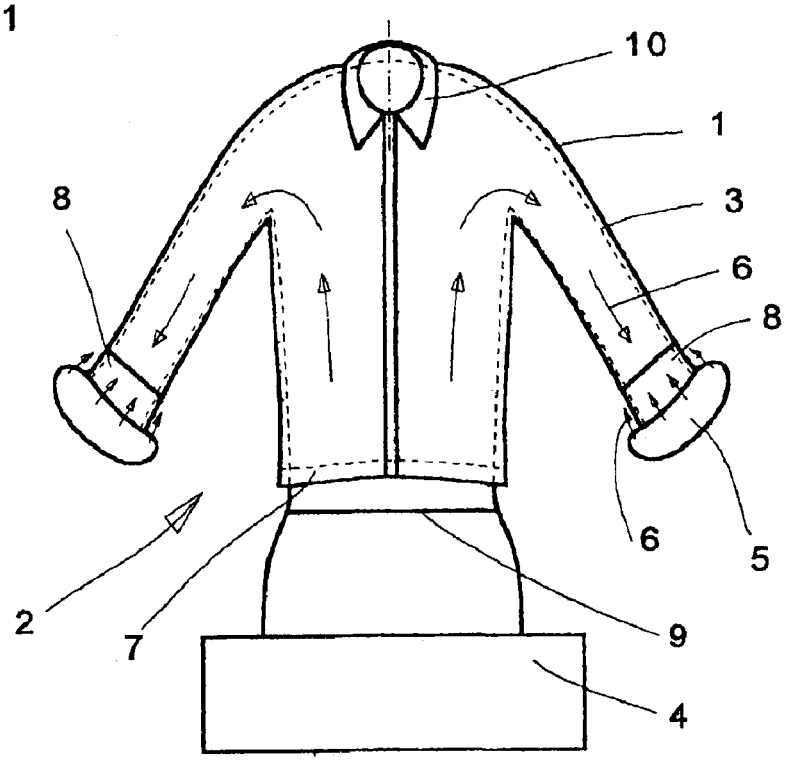
FIG. 1 is an elevational view from the front of a pressing dummy with the air-deflecting device according to the invention in the region of the cuffs.

Referring now to the figures of the drawings in detail and first, particularly to FIG. 1 thereof, there is shown a schematic view of a pressing dummy 2. The pressing dummy 2 substantially includes a base 4, an inflatable bag 3 disposed above the base 4, and a non-illustrated generator for producing an airflow 6. The air generator and a heater can be accommodated in the base 4. In addition, it is also possible to provide a further heater. An item of clothing 1 is disposed on the inflatable bag 3. FIG. 1 shows the pressing dummy 2 during operation, that is to say, the airflow 6 simultaneously blows through the inflatable bag 3—which, in this case, is of air-permeable configuration—and the item of clothing 1.

When the airflow 6 is active, the air-deflecting device or devices 5 according to the invention push out of the sleeves of the item of clothing 1. Because the air-deflecting devices 5 are air-permeable on the side that is oriented toward the item of clothing 1, it is possible for an airflow 6 to pass out here that can dry and press cuffs 8 on the surface of the item of clothing 1.

It is also possible, within the context of the invention, for the air-deflecting device 5 to be disposed in the region of the collar 10 or in the region of the bottom hem 7.

Figure 2:
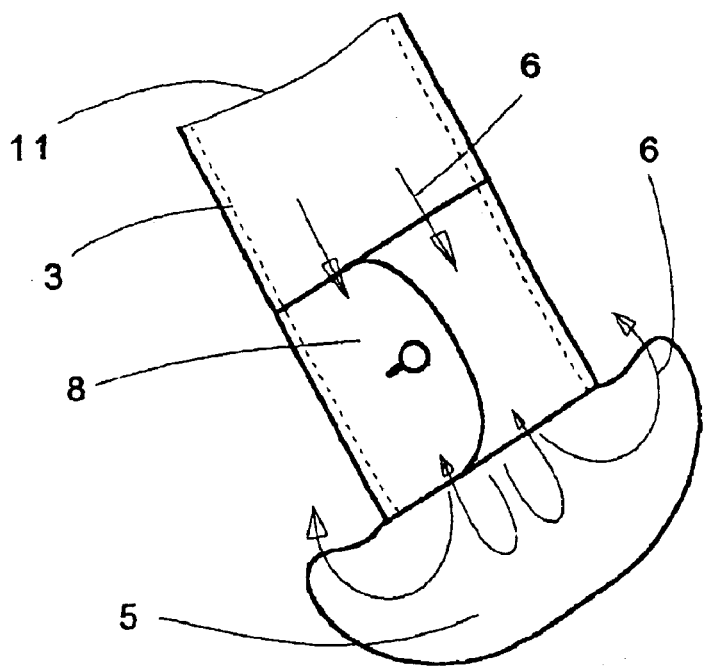
FIG. 2 is a fragmentary, enlarged elevational view of an enlarged detail of the dummy of FIG. 1.

FIG. 2, once again, shows an air-deflecting device 5, this time in enlarged form, in conjunction with its configuration at the end of the sleeve 11 of an item of clothing 1. The airflow 6 in the interior of the inflatable bag 3, first of all, passes through the sleeve 11 on the inside. Of course, in this case—assuming the inflatable bag 3 is air-permeable—part of the airflow 6 also passes directly from the interior of the inflatable bag 3, through the fabric of the item of clothing 1, in the outward direction. This is also true for the cuff 8. As the airflow 6 continues out of the sleeve, it is directed over the cuff 8 again in the opposite direction by the air-deflecting device 5 of the present invention. The cuff 8 is, thus, also dried and pressed from the outside.

We claim:

1. A method of pressing items of clothing, which comprises:

providing a pressing dummy having:

an inflatable bag with at least one sub-region extending into an opening of the item of clothing intended for part of a human body as far as at least one end of the clothing item during a pressing operation; and an air-deflecting device disposed at the at least one end; and filling the inflatable bag with an airflow during the pressing operation:

to extend the at least one sub-region into the opening of the clothing item as far as the at least one end of the clothing item; and to also blow through the air-deflecting device to influence a shape of the air-deflecting device and, dependent upon a compressive force of the airflow, to influence at least one of a position and an angle of a flow direction of the airflow; and tensioning the air-deflecting device in an active airflow and, as a result, directing the flow direction of the airflow on a surface of the clothing item at the latest once the air-deflecting device has been tensioned to a full extent thereof.

2. The method according to claim 1, which further comprises relieving the air-deflecting device of tensioning in an at least reduced airflow and, then, drawing the air-deflecting device back beneath a surface of the clothing item.

3. The method according to claim 1, which further comprises relieving the air-deflecting device of tensioning in an at least reduced airflow and, then, drawing the air-deflecting device back beneath the surface of the clothing item.

4. The method according to claim 1, which further comprises carrying out the directing step by directing the flow direction of the airflow on cuffs of the clothing item at the latest once the air-deflecting device has been tensioned to a full extent thereof.

5. The method according to claim 1, which further comprises carrying out the directing step by directing the flow direction of the airflow on cuffs of the clothing item at the latest once the air-deflecting device has been tensioned to a full extent thereof, the cuffs being adjacent the air-deflecting device.

6. The method according to claim 1, which further comprises carrying out the directing step by directing the flow direction of the airflow on a collar of the clothing item at the latest once the air-deflecting device has been tensioned to a full extent thereof.

7. The method according to claim 1, which further comprises carrying out the directing step by directing the flow direction of the airflow on a collar of the clothing item at the latest once the air-deflecting device has been tensioned to a full extent thereof, the collar being adjacent the air-deflecting device.

8. The method according to claim 1, which further comprises carrying out the directing step by directing the flow direction of the airflow on a bottom hem of the clothing item at the latest once the air-deflecting device has been tensioned to a full extent thereof.

9. The method according to claim 1, which further comprises carrying out the directing step by directing the flow direction of the airflow on a bottom hem of the clothing item at the latest once the air-deflecting device has been tensioned to a full extent thereof, the bottom hem being adjacent the air-deflecting device.

10. The method according to claim 1, which further comprises pressing at least one of shirts, blouses, and jackets with the inflatable bag.

11. An apparatus for pressing items of clothing, comprising:

a pressing dummy having:

an inflatable bag with at least one sub-region extending into an opening of the item of clothing intended for part of a human body as far as at least one end of the clothing item during a pressing operation; and an air-deflecting device disposed at the at least one end and directing the flow direction of the airflow on a surface of the clothing item, said air-deflecting device:

extending said at least one sub-region into the opening of the clothing item as far as the at least one end of the clothing item when the inflatable bag is filled with an airflow during the pressing operation; and having:

a shape influenced by the airflow blowing through said air-deflecting device; and at least one of a position and an angle influenced by a flow direction of the airflow dependent upon a compressive force of the airflow;

said at least one sub-region having an end; and said air-deflecting device being said end of said at least one sub-region and swelling out when influenced by the airflow.

12. The apparatus according to claim 11, wherein said air-deflecting device has air holes.

13. The apparatus according to claim 11, wherein said air-deflecting device is at least partly of an air-permeable material.

14. The apparatus according to claim 11, wherein said inflatable bag is air-impermeable.

15. An apparatus for pressing items of clothing, comprising:

a pressing dummy having:

an inflatable bag with at least one sub-region extending into an opening of the item of clothing intended for part of a human body as far as at least one end of the clothing item during a pressing operation; and an air-deflecting means disposed at the at least one end and directing the flow direction of the airflow on a surface of the clothing item, said air-deflecting means:

extending said at least one sub-region into the opening of the clothing item as far as the at least one end of the clothing item when the inflatable bag is filled with an airflow during the pressing operation; and having:

a shape influenced by the airflow blowing through said air-deflecting means; and at least one of a position and an angle influenced by a flow direction of the airflow dependent upon a compressive force of the airflow;

said at least one sub-region having an end; and said air-deflecting means being said end of said at least one sub-region and swelling out when influenced by the airflow.

16. An apparatus for pressing items of clothing, comprising:

a pressing dummy having:

an inflatable bag with at least one sub-region extending into an opening of the item of clothing intended for part of a human body as far as at least one end of the clothing item during a pressing operation; and an air-deflecting device disposed at the at least one end and directing the flow direction of the airflow on a surface of the clothing item, said air-deflecting device:

extending said at least one sub-region into the opening of the clothing item as far as the at least one end of the clothing item when the inflatable bag is filled with an airflow during the pressing operation; and having:

a shape influenced by the airflow blowing through said air-deflecting device; and at least one of a position and an angle influenced by a flow direction of the airflow dependent upon a compressive force of the airflow;

said at least one sub-region having an end; and said air-deflecting device being parts formed integrally on said end of said at least one sub-region of said inflatable bag.

17. The apparatus according to claim 16, said air-deflecting device has air holes.

18. The apparatus according to claim 16, wherein said air-deflecting device is at least partly of an air-permeable material.

19. The apparatus according to claim 16, wherein said inflatable bag is air-impermeable.

20. An apparatus for pressing items of clothing, comprising:

a pressing dummy having:

an inflatable bag with at least one sub-region extending into an opening of the item of clothing intended for part of a human body as far as at least one end of the clothing item during a pressing operation; and an air-deflecting means disposed at the at least one end and directing the flow direction of the airflow on a surface of the clothing item, said air-deflecting means:

extending said at least one sub-region into the opening of the clothing item as far as the at least one end of the clothing item when the inflatable bag is filled with an airflow during the pressing operation; and having:

a shape influenced by the airflow blowing through said air-deflecting means; and at least one of a position and an angle influenced by a flow direction of the airflow dependent upon a compressive force of the airflow;

said at least one sub-region having an end; and said air-deflecting means being parts formed integrally on said end of said at least one sub-region of said inflatable bag.

* * * * *